United States Patent [19]

Lanzisera

[11] 4,069,533

[45] Jan. 24, 1978

[54] WASHING MACHINE FOR CLEANING COOKING POTS OR SIMILAR ARTICLES

[76] Inventor: Joseph C. Lanzisera, 43 Jackson Ave., Bayville, N.Y. 11709

[21] Appl. No.: 675,923

[22] Filed: Apr. 12, 1976

[51] Int. Cl.[2] ..... A46B 13/06

[52] U.S. Cl. ..... 15/56

[58] Field of Search ..... 15/56–58, 15/70–73, 75, 76

[56] References Cited

U.S. PATENT DOCUMENTS

| | | | |
|---|---|---|---|
| 1,622,130 | 3/1927 | Boyd | 15/56 |

FOREIGN PATENT DOCUMENTS

| | | | |
|---|---|---|---|
| 1,218,501 | 12/1959 | France | 15/56 |
| 1,260,935 | 4/1961 | France | 15/56 |
| 1,439,607 | 4/1966 | France | 15/56 |
| 306,694 | 2/1929 | United Kingdom | 15/75 |

*Primary Examiner*—Edward L. Roberts

*Attorney, Agent, or Firm*—Irving M. Kriegsman

[57] ABSTRACT

A washing machine for cleaning cooking pots or similar articles is disclosed. The machine includes a plurality of upwardly extending washer-scrubber units for cleaning the inside surfaces of the pots and a single downwardly extending washer-scrubber unit for cleaning the bottom outside surfaces of the pots. The pots are placed on top of the upwardly extending washer-scrubber units in an inverted position and are supported by the upwardly extending washer-scrubber units while they are being cleaned. Each washer-scrubber unit includes a brush attached to a rotating sprinkler. Three embodiments of the invention are described. In one embodiment, the upwardly extending washer-scrubber units are mounted on a pull-out tray. In another embodiment, the upwardly extending washer-scrubber units are mounted on an indexing turntable. In a third embodiment, the upwardly extending washer-scrubber units are mounted on indexing straight line conveyor chains.

5 Claims, 8 Drawing Figures

WASHING MACHINE FOR CLEANING COOKING POTS OR SIMILAR ARTICLES

BACKGROUND OF THE INVENTION

This invention relates to washing machines. More particularly, this invention relates to a washing machine for cleaning cooking pots and similar articles.

In order to effectively and efficiently clean a cooking pot it is usually necessary that its surfaces be scrubbed with a brush or similar device. Simply immersing the pot in a cleaning solution and then agitating the cleaning solution or spraying the surfaces of the pot with a cleaning solution will not generally remove all of the food particles, grease or other foreign matter that might have adhered to it during its normal usage. Domestic and commercial washing machines for dishes are normally provided with some type of means for washing and rinsing the articles being cleaned but are not provided with any means for actually scrubbing the articles being cleaned. Consequently, cooking pots are normally cleaned by hand which can be very hard work, can be very time consuming and can have adverse effects on the natural skin beauty of the hands.

In U.S. Pat. No. 843,555, U.S. Pat. No. 1,018,046, U.S. Pat. No. 1,492,925, U.S. Pat. No. 1,602,667, U.S. Pat. No. 2,062,664, and U.S. Pat. No. 2,475,407 are disclosed various types of washing machines for cleaning various types of articles. In each one of these patents the articles being cleaned are placed in the machine in an inverted position and are then spray washed with a liquid supplied through suitably positioned nozzles or jets. None of the machines described in these patents are provided with any means for scrubbing the articles as they are being washed and none of these patents are designed or suited specifically for cleaning cooking pots.

In U.S. Pat. No. 2,908,598 is disclosed a machine for cleaning glass articles, such as tumblers, one at a time. The machine includes a plurality of rotating, mechanically driven, brushes which scrub the interior and exterior surfaces of the article being cleaned.

In U.S. Pat. No. 2,558,628 is disclosed a machine for washing milking machines in which the action of a fluid ejected through nozzles at the ends of a blade is used to produce rotational movement of frame having a plurality of upstanding spray tubes. The machine does not include any brushes or other means for scrubbing the surfaces of the milking machines.

SUMMARY OF THE INVENTION

It is an object of this invention to provide a new and improved washing machine.

It is another object of this invention to provide a washing machine that is especially suited for cleaning cooking pots and similar articles.

It is another object of this invention to provide a new and novel technique for producing rotational movement of a scrubbing brush.

It is still another object of this invention to provide a washing machine capable of cleaning a plurality of cooking pots at the same time and wherein the cleaning cycle for each pot may be independently controlled.

It is another object of the invention to provide a washing machine for washing and scrubbing cooking pots and similar articles.

It is yet still another object of this invention to provide a washing machine for cleaning pots that includes means for scrubbing the interiors and bottom exteriors of each pot being cleaned at the same time as it is being washed.

It is another object of this invention to provide a new and novel method for simultaneously washing and scrubbing a surface which is to be cleaned.

It is still another object of this invention to provide a new and novel apparatus for washing and scrubbing the inside surface of a cylindrically-shaped container.

Finally, it is an object of the invention to provide an apparatus for washing and scrubbing cooking pots which is relatively simple in construction and which can be easily incorporated into most commercial and domestic dishwashers.

The above and other objects are achieved by constructing a washing machine according to this invention.

One of the principal features of this invention involves the concept of fastening a brush to a rotating sprinkler in order to provide a means for scrubbing a surface at the same time as the surface is being washed by the fluid emitted from the sprinkler.

A washing machine constructed according to this invention includes a plurality of upwardly extending washer-scrubber units. Each unit includes a brush (or soap pad or similar device) fastened to a rotating sprinkler. Each article to be cleaned is placed on the top of one of the units in an inverted position. As the sprinkler rotates the water or other cleaning solution emitted therefrom washes the surface of the article. At the same time the brush, which also rotates since it is connected to the sprinkler scrubs the surface of the article. A similar type of washer-scrubber unit, properly positioned, washes and scrubs the bottom outer surfaces of the articles. In one embodiment of the invention which is described in detail, the washer-scrubber units for the inside surfaces of the articles are mounted on a pull-out tray. In a second embodiment of the invention which is described in detail, the washer-scrubber units for the inside surfaces of the articles are mounted on an indexing turntable. In a third embodiment of the invention, the washer-scrubber units for the inside surfaces of the articles are mounted on indexing straight line conveyor chains.

IN THE DRAWINGS

DETAILED DESCRIPTION

Figure 6:
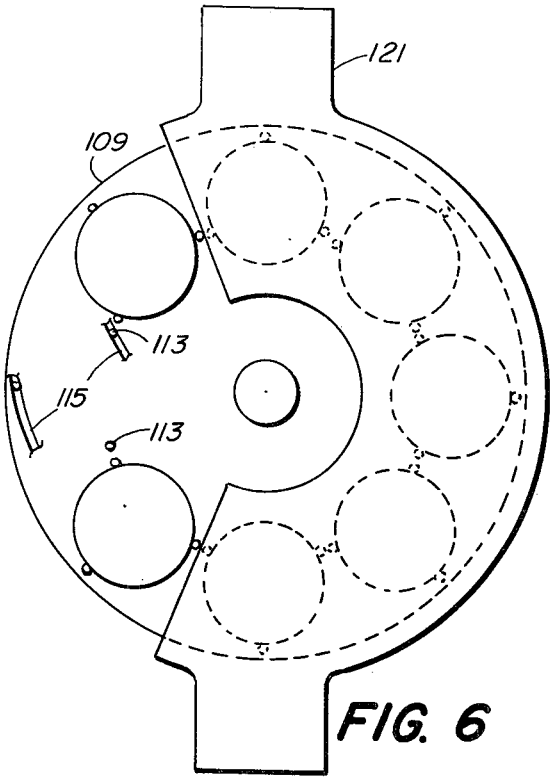
FIG. 6 is an end view of the invention shown in FIG. 5.

Referring to the drawings, there is shown in FIGS. 1–4 a washing machine 11 constructed according to this invention. The washing machine 11 includes a casing 13 which forms a closed chamber where the pots P (or similar articles) are cleaned. The casing 13 includes a door 15 through which the pots P are inserted into the chamber and a removable panel 17 behind which are located the various pumps, cams, timers, solenoids, motor and switches, etc. for operating the machine. The door 15 is mounted on the casing 13 by hinges 19 and includes a glass window 21 for viewing the chamber.

Figure 3:
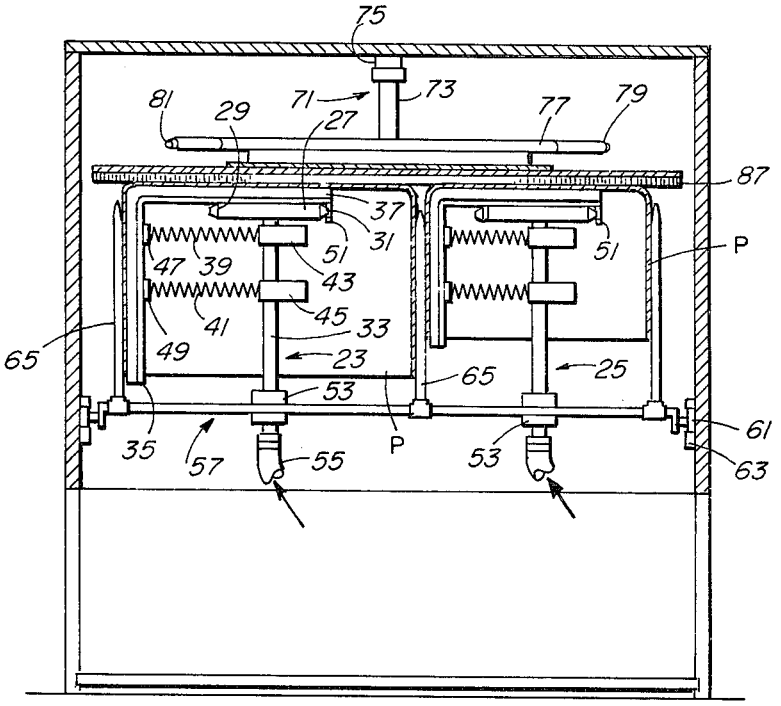
FIG. 3 is a sectional elevation view of the invention shown in FIG. 1 taken along lines 2—2 in FIG. 2.

Inside the chamber are a plurality of upwardly extending washer-scrubber units. In order not to render the drawings entangled, the section view in FIG. 3 is taken in such a way that only two upwardly extending washer-scrubber units 23 and 25 are shown. The pots P to be cleaned are placed on top of the upwardly extending washer-scrubber units in an inverted position. Except for size, the upwardly extending washer-scrubber units are all identical. Consequently, only washer-scrubber unit 23 will be described in detail.

Unit 23 is made up basically of a brush assembly mounted on a rotating sprinkler.

The rotating sprinkler includes a horizontal pipe 27 having spray type end nozzles 29 and 31. Horizontal pipe 27 is rigidly mounted on the top of a vertical pipe 33 so as to form a "T", with the interiors of the two pipes 27 and 33 being in communication with each other.

The brush assembly includes an "L" shaped brush 35 which is removably mounted by suitable means (not shown) on an "L" shaped brush holder 37. The "L" shaped brush holder 37 is mounted for slidable movement along the top of the horizontal pipe 27. A pair of springs 39 and 41 are connected to the vertical pipe 33 by brackets 43 and 45 and to the brush holder 37 by lugs 47 and 49 so as to push brush holder 37 away from pipe 33 and cause the vertical arm of brush 35 to come into contact with the inner side wall of the pot P. A stop 51 on the end of brush holder 37 limits the slidable movement of brush holder 37 along the horizontal pipe 27. Vertical pipe 33 is rotatably mounted on a joint or coupling 53. A rubber hose 55 is attached to the coupling 53 and is connected to a source of water or cleaning solution under pressure (not shown). Except for the size of the brush, the brush holder and the horizontal pipe, washer-scrubber unit 25 is identical to washer-scrubber unit 23.

Couplings 53 are fixedly mounted on a pull-out tray 57 made up essentially of a plurality of longitudinal and lateral ribs 59. Tray 57 is slidably mounted by wheels 61 on tracks 63 fixed to the sidewalls of the chamber. A plurality of upwardly extending rubber pipes or fingers 65 are mounted for slidable movement on the ribs 59. The fingers 65 are provided with spring biased lock means (not shown) so that they can be held at desired locations. In use, the fingers 65 are nested up against the outer walls of the pots P in order to prevent tilting or rotational or sidewise movement of the pots P during the cleaning operation.

Machine 11 further includes a downwardly extending washer-scubber unit 71 for washing and scrubbing the bottom outer surfaces of the pots P. Unit 71 also serves to hold down the pots P while their inner surfaces are being cleaned. Unit 71 is also made up basically of a brush assembly mounted on a rotating "T" shaped sprinkler. Specifically, unit 71 includes a vertical pipe 73 rotatably mounted on its upper end to a coupling 75 secured to the top wall of the chamber at the center. The coupling 75 is connected by a pipe or hose (not shown) to a source of fluid under pressure (not shown). A horizontal pipe 77 having spray-type end nozzles 79 and 81 is rigidly fixed to the bottom end of pipe 73 so as to form an inverted "T", with the interiors of the two pipes being in communication with each other. Rigidly secured to the horizontal pipe 77 and positioned directly underneath the horizontal pipe 77 is a spider assembly 81 made up of a circular plate 83 having a plurality of radially extending removable arms 85. A removable brush 87 is mounted on the underside of each arm 85.

In operation, the tray 57 is pulled out and the pots P which are to be cleaned are placed on top of the upwardly extending washer-scrubber units in an inverted position. The center of each pot P is lined up with the axis of rotation of its respective washer-scrubber unit. Once the pots are properly positioned, fingers 65 are nested up against the sides of the pots P and locked in place to prevent the pots P or the handles on the pots P from moving or tilting during the washing and scrubbing cycle. The tray 57 is then pushed back into the chamber. The spacing between the upwardly extending washer-scrubber units and the downwardly extending washer scrubber unit is such that the brushes 87 contact the outer bottom surfaces of the pots P. The sprinklers are activated by directing water or other cleaning solution under pressure through vertical pipes and out through the end nozzles in the horizontal pipes. Fluid emerging through the end nozzles produce a rotational movement of the sprinklers. As the sprinklers turn, the brushes also move since they are mounted on the sprinklers and as a result scrub the surfaces that are being spray washed.

The machine 11 is preferably cycled so that the washer-scrubber unit for the outside bottom surface of the pots P is not activated at the same time as the washer-scrubber units for the inside surfaces of the pots P. In this way the washer-scrubber unit for the outside bottom surfaces of the pots P also serves to hold the pots P down in place while the inside surfaces are being cleaned. The cycling may also be arranged so that the inside surfaces of each pot P are cleaned in sequence rather than simultaneously. The desired cycling of the machine 11 may be obtained by using any conventional arrangement of cams, limit switches and solenoid valves (not shown). Used cleaning solution drains out of the chamber of the machine through a filter 91 at the bottom of the chamber.

The brush holders for the inside surfaces are self-adjusting due to the action of the springs connected between the vertical pipes and the brush holders and can thus accomodate different sized pots. The only limitation with regard to the size of the inside washer-scrubber units is that the length of the horizontal arms of the brushes as well as the length of the horizontal pipes be less than the diameter of the pot P it is intended to support. Therefore, to accomodate very small as well as very large pots, it may be desirable to have different sized washer-scrubber units, as is shown in the drawings.

Figure 5:
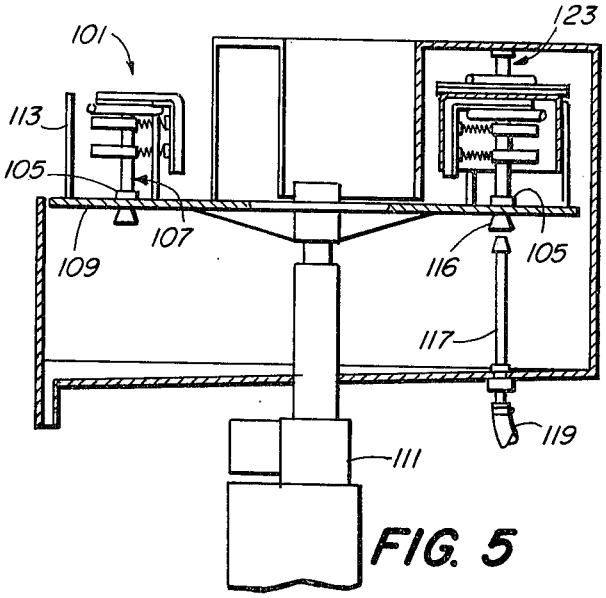
FIG. 5 is a section view of another embodiment of the invention.
Figure 4:
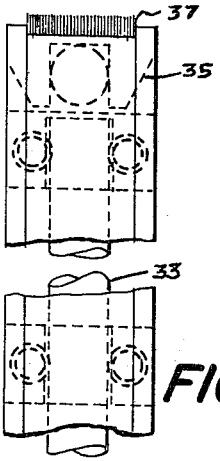
FIG. 4 is a sectional end view of one of the washer-scrubber units shown in FIG. 2.
Figure 1:
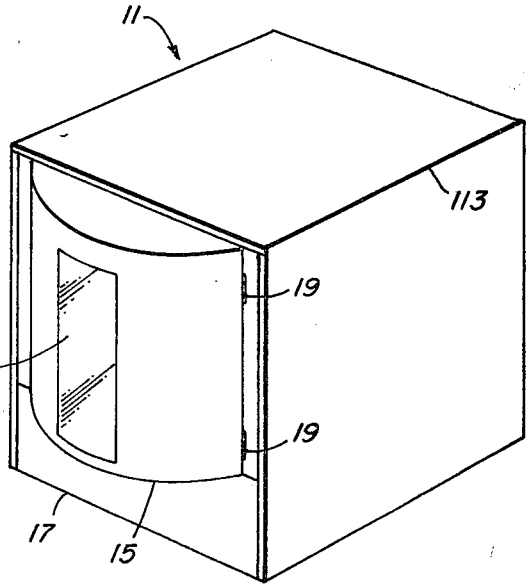
FIG. 1 is a perspective view of one embodiment of a washing machine constructed according to this invention.

In FIGS. 5 and 6 is a second embodiment of the invention. In this embodiment of the washing machine designated by reference numeral 101, the couplings 105 for the upwardly extending washer-scrubber units 107 are mounted on a turntable 109 which is driven by an indexing motor 111. Movable fingers 113 for holding the pots P in position are mounted in circular grooves 115 on the turntable 87. As the turntable 109 is moved each coupling 105 is successively brought into registration with a jetstream of water from a nozzle 116 which is connected by a pipe 117 to a hose 119 connected to a source of water or other cleaning solution (not shown). Extending downward from the top wall 121 of the cover of the machine 101 and in alignment with the nozzle 115 is a downwardly extending washer scrubber unit 123 (similar to the downwardly extending washer-scrubber unit in the FIG. 1 embodiment) for washing the outer bottom surface of the pots.

Figure 8:
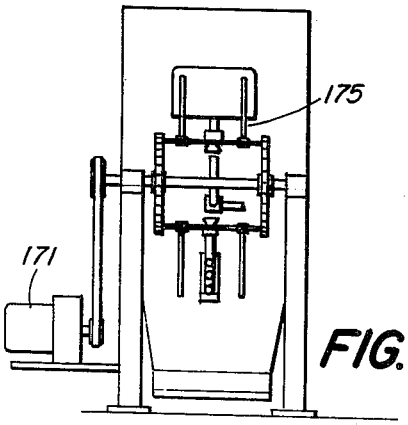
FIG. 8 is an end view of the invention shown in FIG. 7.
Figure 7:
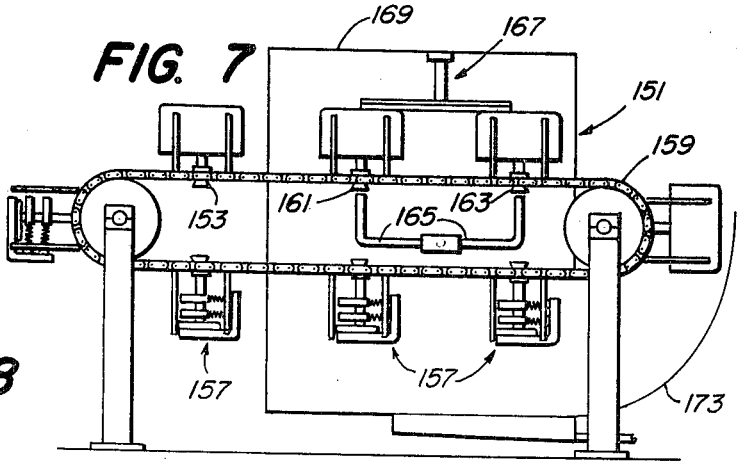
FIG. 7 is a section view of another embodiment of the invention.
Figure 2:
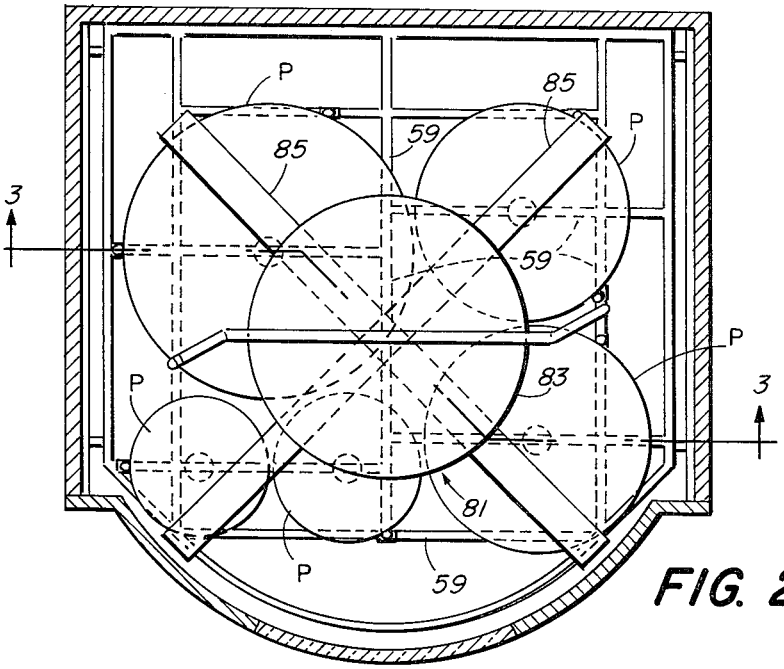
FIG. 2 is a sectional plan view of the invention shown in FIG. 1.

In FIGS. 7 and 8 is a third embodiment of the invention. In this embodiment of the washing machine designated by the reference numeral 151, the couplings 153 of the washer-scrubber units 157 are mounted on a pair of straight line index type conveyor chains 159 and are unconnected at their bottom ends (similar to the couplings 105 in the FIG. 5 embodiment). Machine 151 includes a pair of a jet nozzles 161 and 163 connected by a pipe 165 to a source of water or other cleaning solution under pressure (not shown). Machine 151 also includes a downwardly extending washer-scrubber unit 167 fixed to a hood 169 (and similar to the washer-scrubber unit 123 in the FIG. 5 embodiment). Chains 159 are driven by an indexing motor 171. After the pots P are cleaned they drop off into a chute 173. Adjustable fingers 175 for holding the pots P in position are mounted on carrier rods 177 connected to the chains 159.

It is to be understood that one or more washer-scrubber units constructed according to this invention for cleaning the inner surfaces of a pot could easily be incorporated into a commercial or domestic dishwasher so that the dishwasher could also be used to clean pots at the same time as cleaning dishes. For example, one or more of such units could probably be mounted on the bottom pull-out tray in a conventional household dishwasher with a minimum amount of design changes.

The embodiments of the present invention are intended to be merely exemplary and those skilled in the art shall be able to make numerous variations and modifications without departing from the spirit and scope of the present invention. For example, instead of a sprinkler wherein the horizontal pipe is fixed to a vertical pipe that is rotatably mounted on a coupling, a sprinkler could be provided where the horizontal pipe is rotatably mounted on a vertical pipe that is fixedly mounted on a coupling. Also, separate washer-scrubber units could be provided for washing and scrubbing the bottom outer surfaces of each pot. These and all other such variations and modifications are intended to be within the scope of the present invention as defined in the appended claims.

What is claimed is:

1. A washing machine for cleaning cooking pots comprising:

a. a plurality of upwardly extending washer-scrubber units, each upwardly extending washer-scrubber unit being adapted to support a cooking pot in an inverted position, each upwardly extending washer-scrubber unit including:
   1. a rotatably mounted "T" shaped sprinkler having spray type end nozzles,
   2. a brush mounted on the sprinkler, and
   3. spring means for urging the brush outward against the inside of the cooking pot, b. means for supporting the washer-scrubber units, c. means for supplying cleaning fluid under pressure to the rotating sprinklers, the fluid emerging from the spray nozzles producing rotational movement of the sprinkler, d. a housing, and e. a pull-out tray mounted within the housing for supporting the means for supporting the washer-scrubber units.

2. A washing machine for cleaning cooking pots comprising:

a. a plurality of upwardly extending washer-scrubber units, each upwardly extending washer-scrubber unit being adapted to support a cooking pot in an inverted position, each upwardly extending washer-scrubber unit including:
   1. a rotatably mounted "T" shaped sprinkler having spray type end nozzles,
   2. a brush mounted on the sprinkler, and
   3. spring means for urging the brush outward against the inside of the cooking pot, b. means for supporting the washer-scrubber units, c. means for producing an upwardly directed jet stream of cleaning fluid, d. a base, e. an indexing turntable rotably mounted on the base for supporting the means for supporting the washer-scrubber units and positioned so as to successively bring each "T" shaped sprinkler into registration with said jet stream of cleaning fluid, and f. a cover fixed relative to the base and extending over the area containing said jet stream of cleaning fluid.

3. A washing machine for cleaning cooking pots comprising:

a. a plurality of upwardly extending washer-scrubber units, each upwardly extending washer-scrubber unit being adapted to support a cooking pot in an inverted position, each upwardly extending washer-scrubber unit including:
   1. a rotatably mounted "T" shaped sprinkler having spray type end nozzles,
   2. a brush mounted on the sprinkler, and
   3. spring means for urging the brush outward against the inside of the cooking pot, b. means for supporting the washer-scrubber units, c. means for producing an upwardly directed jet stream of cleaning fluid, d. a base, e. a pair of motor driven straight line index type conveyor chains mounted on the base for supporting the means for supporting the washer-scrubber units and positioned so as to successively bring each "T" shaped sprinker into registration with sand jet stream of cleaning fluid, and f. a hood fixed relative to the base and extending over the area containing said jet streams of cleaning fluid.

4. A washing machine, for cleaning cooking pots comprising:

a. a plurality of upwardly extending washer-scrubber units, each upwardly extending washer-scrubber unit being adapted to support a cooking pot in an inverted position, each upwardly extending washer-scrubber unit including:
   1. rotatably mounted "T" shaped sprinkler having spray type end nozzles,
   2. a brush mounted on the sprinkler, and
   3. spring means for urging the brush outward against the inside of the cooking pot, b. means for supporting the washer-scrubber units, c. means for supplying cleaning fluid under pressure to the rotating sprinklers, the fluid emerging from the spray nozzles producing rotational movement of the sprinklers, d. means for washing and scrubbing the bottom outer surfaces of the cooking pots, said means including a rotably mounted inverted "T" shaped sprinkler and a brush assembly attached to said sprinkler, said brush assembly including a circular plate, a plurality of horizontally extending arms attached to said plate and a brush mounted on each arm, and e. a plurality of vertically extending fingers slidably mounted on the means for supporting the washer-scrubber units for nesting up against the sidewalls of the pots for preventing rotational and/or tilting movement of the pots while they are being washed.

5. The washing machine of claim 4 and wherein the inverted "T" shaped sprinkler is centrally located relative to the upwardly extending washer-scrubber units and serves to hold the pots in place while they are being cleaned by the upwardly extending washer-scrubber units.

* * * * *